US008926122B2

(12) United States Patent
Cavenati et al.

(10) Patent No.: US 8,926,122 B2
(45) Date of Patent: Jan. 6, 2015

(54) STAGE LIGHT FIXTURE

(75) Inventors: Angelo Cavenati, Brusaporto (IT); Pasquale Quadri, Torre de' Roveri (IT)

(73) Assignee: Clay Paky S.p.A., Seriate (IT)

( * ) Notice: Subject to any disclaimer, the term of this patent is extended or adjusted under 35 U.S.C. 154(b) by 227 days.

(21) Appl. No.: 13/576,604

(22) PCT Filed: Jul. 9, 2010

(86) PCT No.: PCT/IB2010/001685

§ 371 (c)(1),
(2), (4) Date: Sep. 17, 2012

(87) PCT Pub. No.: WO2011/098858

PCT Pub. Date: Aug. 18, 2011

(65) Prior Publication Data

US 2013/0010466 A1 Jan. 10, 2013

(30) Foreign Application Priority Data

Feb. 12, 2010 (IT) ..... MI2010A0209

(51) Int. Cl.

| | |
|---|---|
| ***F21V 21/00*** | (2006.01) |
| ***F21S 8/00*** | (2006.01) |
| *F21W 131/406* | (2006.01) |
| *F21Y 113/00* | (2006.01) |
| *F21Y 113/02* | (2006.01) |

(52) U.S. Cl.

CPC ..... *F21S 8/00* (2013.01); *F21W 2131/406* (2013.01); *F21Y 2113/00* (2013.01); *F21Y 2113/02* (2013.01)

USPC ..... 362/235

(58) Field of Classification Search

CPC ..... F21V 21/00; F21V 21/14; F21S 8/00; F21S 8/04; F21W 2131/406; F21Y 2113/00; F21Y 2113/02; H05B 31/0036

See application file for complete search history.

(56) References Cited

U.S. PATENT DOCUMENTS

| | | | | |
|---|---|---|---|---|
| 4,158,982 | A | 6/1979 | Chusid | |
| 7,527,389 | B2 * | 5/2009 | Belliveau et al. | 362/231 |
| 7,543,955 | B2 * | 6/2009 | Belliveau et al. | 362/231 |
| 2009/0027881 | A1 | 1/2009 | Belliveau et al. | |

FOREIGN PATENT DOCUMENTS

| | | |
|---|---|---|
| DE | 9012286 | 12/1990 |
| DE | 202005013529 | 11/2005 |

* cited by examiner

*Primary Examiner* — Bao Q Truong
(74) *Attorney, Agent, or Firm* — Leason Ellis LLP

(57) ABSTRACT

A stage light fixture having a casing; a supporting structure supporting the casing; and a stroboscopic light source fitted integrally to the casing.

16 Claims, 6 Drawing Sheets

STAGE LIGHT FIXTURE

TECHNICAL FIELD

The present invention relates to a stage light fixture.

BACKGROUND ART

Over the past few years, a demand has arisen for stage light fixtures designed to produce an increasing number of optical effects, while still maintaining compactness of the fixture and good quality of the effects produced.

DISCLOSURE OF INVENTION

It is therefore an object of the present invention to provide a compact stage light fixture designed to produce a satisfactory number of good-quality optical effects.

According to the present invention, there is provided a stage light fixture as claimed in Claim 1.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
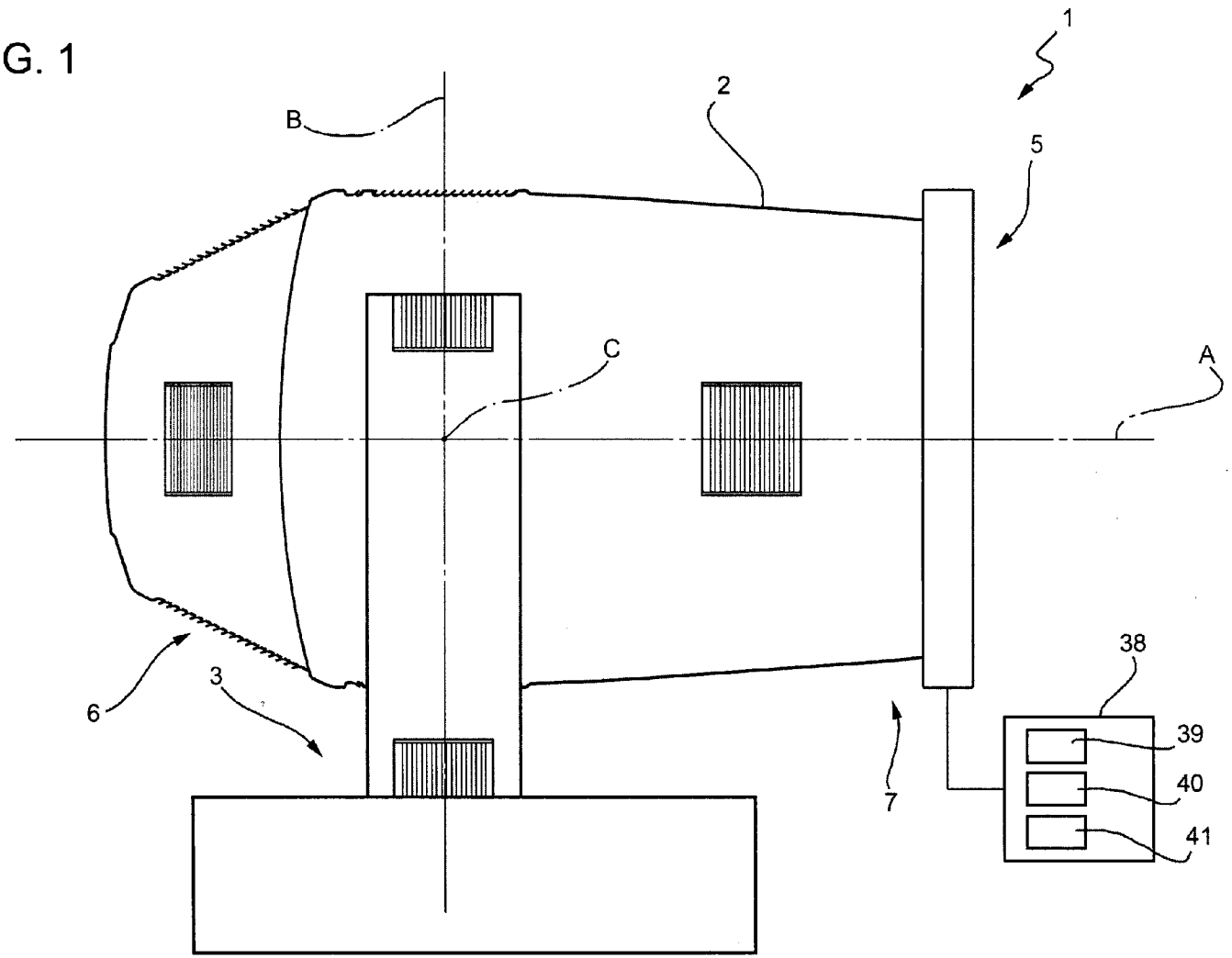
FIG. 1 shows a schematic side view of a stage light fixture in accordance with a first embodiment of the present invention.

Number 1 in FIG. 1 indicates a stage light fixture comprising a casing 2 (shown schematically in FIG. 1); a supporting structure 3 for supporting casing 2; and a strobe assembly 5.

Casing 2 extends along a longitudinal axis A, and has a closed end 6, and an open end 7 opposite closed end 6 along axis A.

Supporting structure 3 and casing 2 are designed to permit rotation of casing 2 about a so-called PAN axis B and TILT axis C perpendicular to each other.

Figure 2:
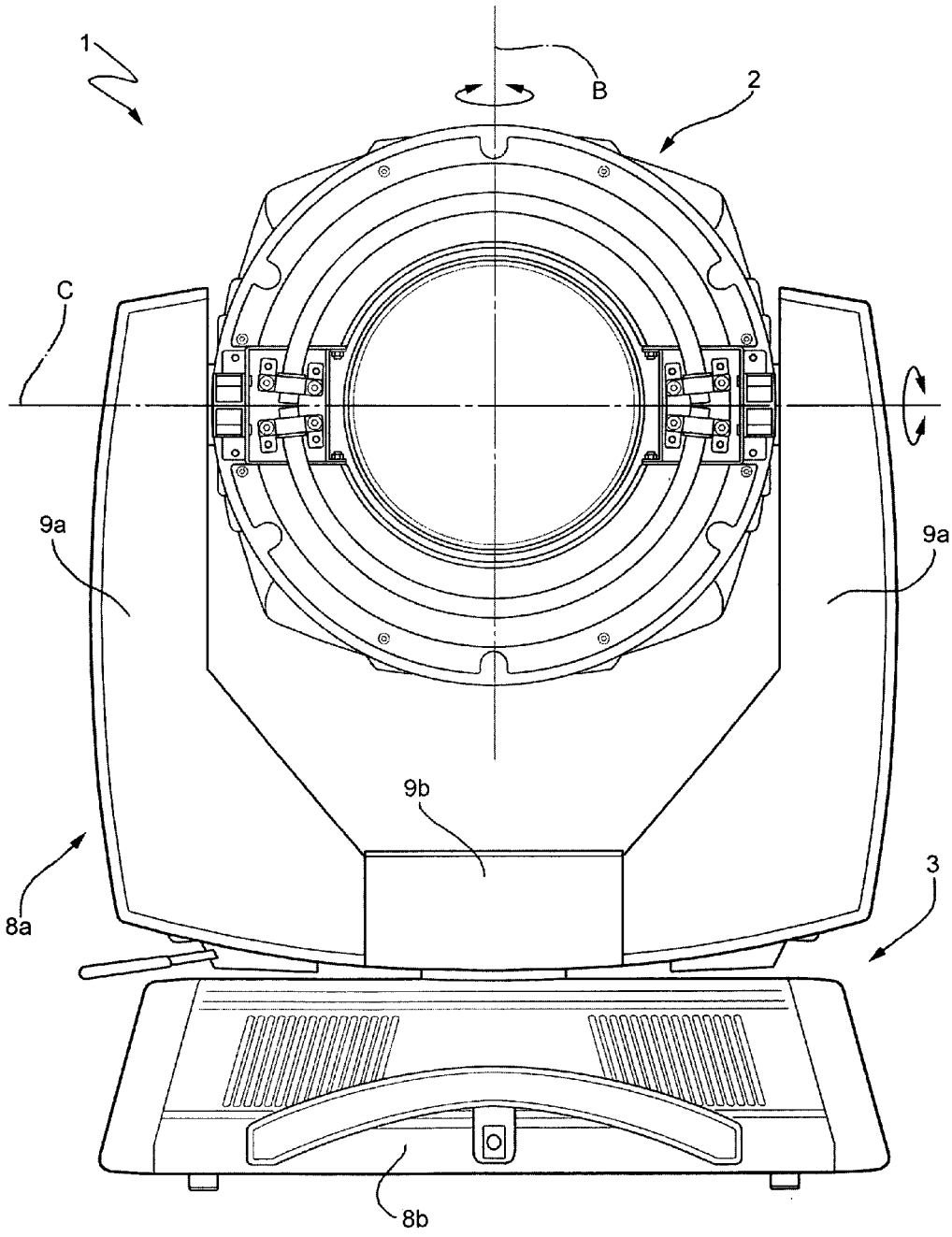
FIG. 2 shows a schematic front view of the FIG. 1 stage light fixture.

With reference to FIG. 2, supporting structure 3 comprises a fork 8*a* and a base 8*b*.

Fork 8*a* is substantially U-shaped, and comprises two arms 9*a*; and a substantially curved portion 9*b* connected to base 8*b* to permit rotation of the fork about PAN axis B.

Arms 9*a* support casing 2 for rotation, in particular for rotation about TILT angle C.

Casing 2 can thus be rotated about both axes B and C.

Strobe assembly 5 is fitted integrally to, and follows the movements of, casing 2.

With reference to FIG. 2, strobe assembly 5 comprises a frame 10; a stroboscopic light source 11; a reflecting member 12; and cooling means 13.

Frame 10 comprises an annular plate 15; and two supports 16 for supporting cooling means 13.

Annular plate 15 is preferably fixed to the open end 7 of casing 2, has a hole 17, and is preferably fitted to the outside of casing 2.

In a variation not shown, annular plate 15 is fixed to the inside of casing 2.

Figure 3:
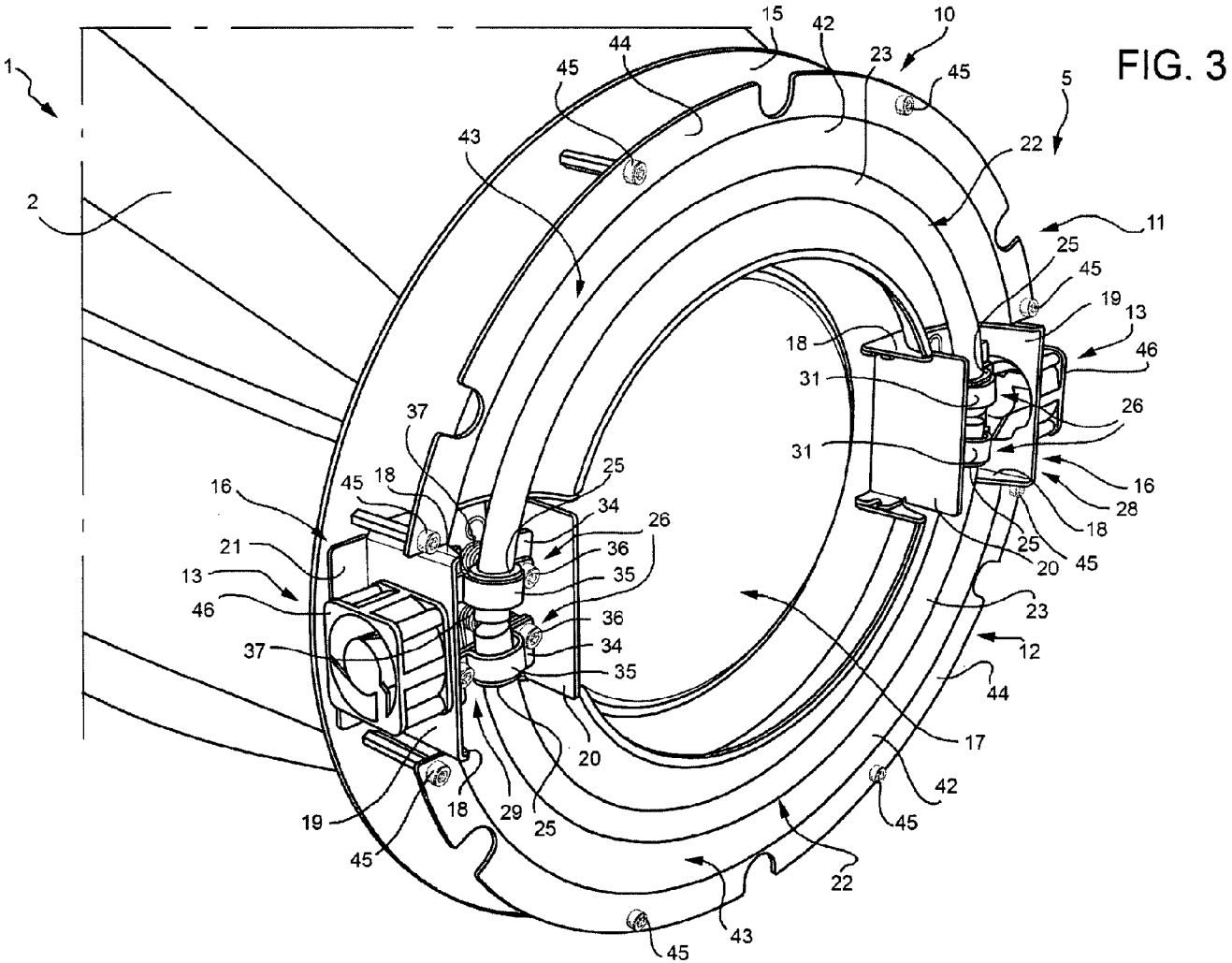
FIG. 3 shows a view in perspective, with parts removed for clarity, of a detail of the FIG. 1 light fixture.
Figure 4:
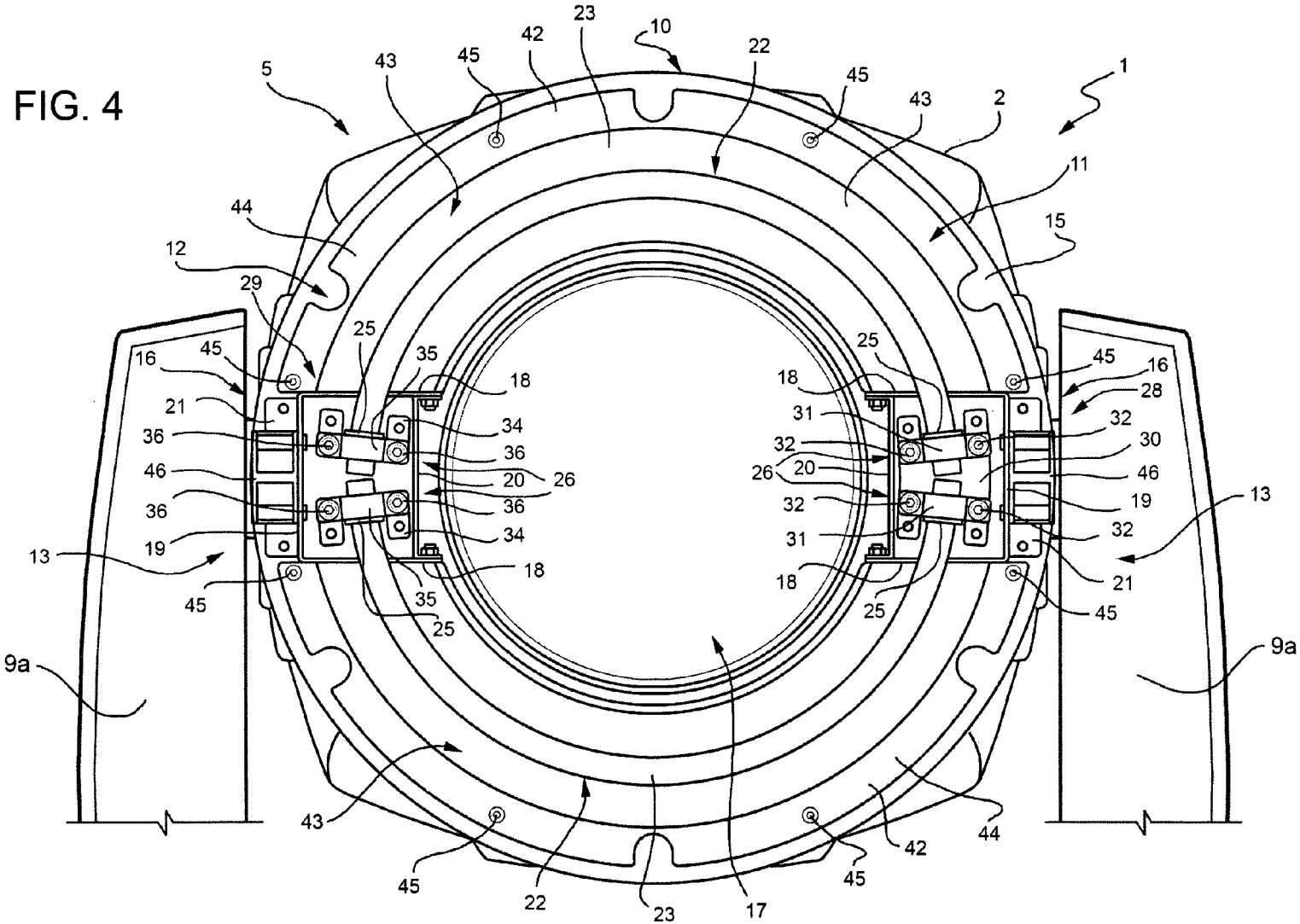
FIG. 4 shows a front view, with parts removed for clarity, of the FIG. 3 detail.

With reference to FIGS. 3 and 4, supports 16 are fixed diametrically opposite each other to plate 15, and each comprise two parallel C-shaped plates 18; a bore plate 19 fitted and perpendicular to the two parallel plates 18; and a plate 20 parallel to bore plate 19 and fitted to parallel plates 18.

More specifically, each bore plate 19 has an appendix 21 perpendicular to bore plate 19 and fixed to annular plate 15 by screws (not shown for the sake of simplicity).

Stroboscopic light source 11 is a source of light pulses of variable rate and intensity.

Preferably, stroboscopic light source 11 comprises at least one lamp for emitting intermittent light.

In the non-limiting example shown and described, the stroboscopic light source comprises two xenon lamps 22.

Each lamp 22 comprises substantially semicircular-arc-shaped tube 23 made of glass or fused quartz. Tube 23 is filled with ionizable gas (in this case, xenon), and has a metal electrode 25 at each end 26.

Lamps 22 are fixed to annular plate 15 with respective ends 26 facing, so as to form a substantially annular stroboscopic light source 11.

A first pair of facing ends 26 is fixed to annular plate 15 by connecting means 28, and the other pair of facing ends 26 is fixed to annular plate 15 by connecting means 29.

More specifically, connecting means 28 comprise an intermediate connecting plate 30, two clamps 31, and four connecting screws 32. Each end 26 in the first pair of facing ends 26 is fixed to intermediate connecting plate 30 by a respective clamp 31, in turn fixed to intermediate connecting plate 30 and to annular plate 15 by two connecting screws 32. Each connecting screw 32 has an elastic damping member 37 (only shown as part of connecting means 29 in FIG. 3) preferably in the form of a coil spring extending about respective connecting screw 32.

Connecting means 29 comprise two intermediate connecting plates 34, two clamps 35, and four connecting screws 36. Each end 26 in the other pair of facing ends 26 is fixed to a respective intermediate connecting plate 34 by a respective clamp 35, in turn fixed to respective intermediate connecting plate 34 and to annular plate 15 by two connecting screws 36. Each connecting screw 36 has an elastic damping member 37 (only shown in FIG. 3) preferably in the form of a coil spring extending about respective connecting screw 36.

With reference to FIG. 1, metal electrodes 25 (only shown in FIGS. 3 and 4) are connected to a control device 38, which comprises an activating module 39 for selectively activating each lamp 22; an intensity regulating module 40 for regulating the intensity of the stroboscopic light emitted by each lamp 22; and a pulse rate regulating module 41 for regulating the pulse rate of the stroboscopic light emitted by each lamp 22.

Control device 38 preferably communicates with a remote control station (not shown in the drawings), and is preferably designed to receive DMX512 protocol signals.

With reference to FIGS. 2 and 3, reflecting member 12 comprises two reflectors 42 for reflecting the light emitted by lamps 22.

More specifically, each reflector 42 is semicircular-arc-shaped, and has a substantially U-shaped cross section to define a seat 43 for respective lamp 22.

Each reflector 42 has an outer edge 44 fixed along its perimeter to annular plate 15 by connecting screws 45, which are preferably four in number and equally spaced along the perimeter of outer edge 44.

Cooling means 13 comprise two cooling fans 46 fixed respectively to bore plates 19 of supports 16, and which in use cool metal electrodes 25 of lamps 22.

A first variation (not shown) of the present invention comprises two glass guards fixed to respective reflectors 42 to protect lamps 22.

A second variation (not shown) of the present invention comprises a protective flange for protecting frame 10, stroboscopic light source 11, reflecting member 12, and cooling means 13.

Figure 5:
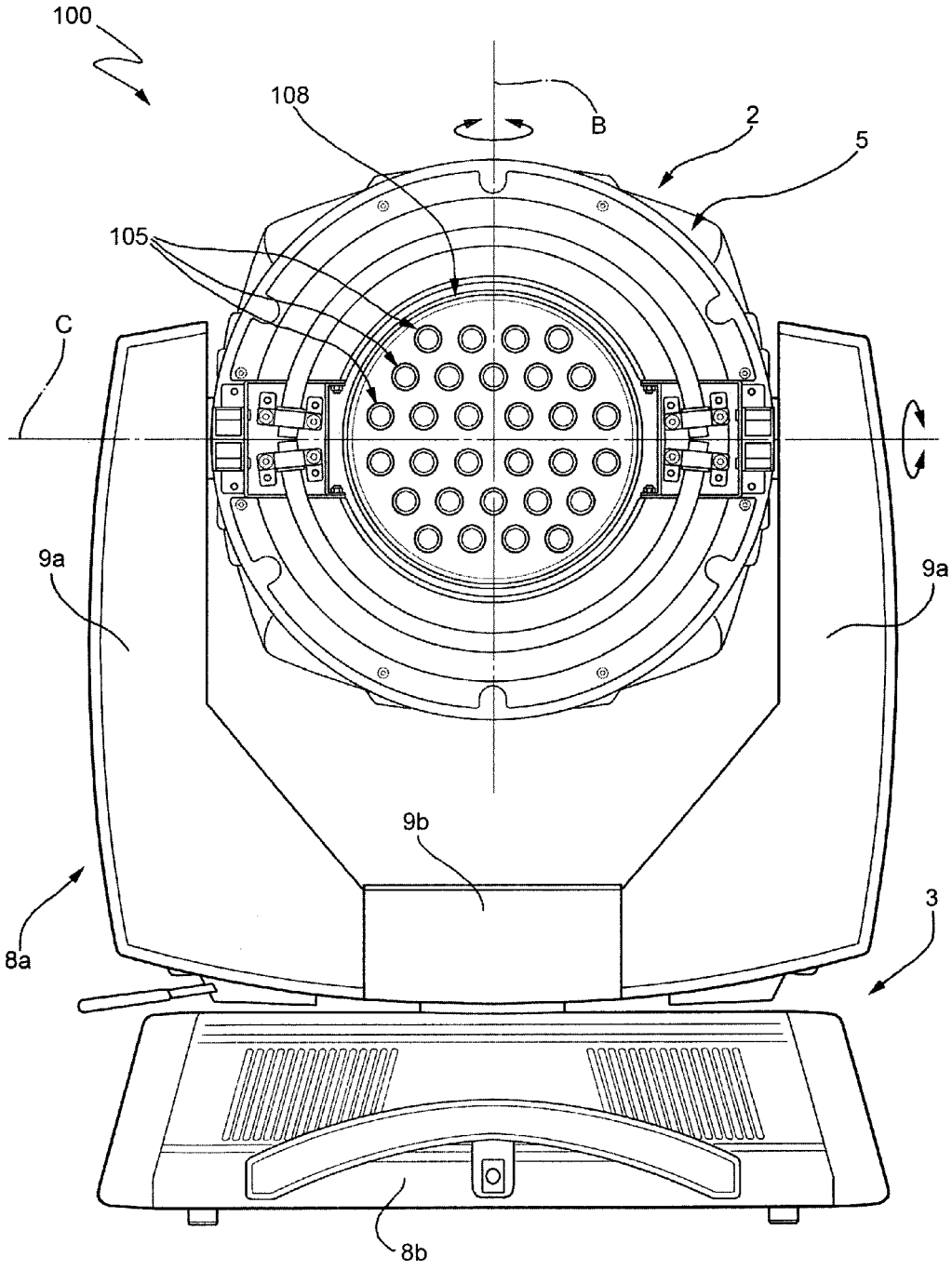
FIG. 5 shows a schematic front view of a stage light fixture in accordance with a second embodiment of the present invention.

FIG. 5 shows a stage light fixture 100 in accordance with a second embodiment.

In FIG. 5, similar parts of light fixtures 1 and 100 are indicated using the same reference numbers as in FIGS. 1-4.

Light fixture 100 differs from light fixture 1 by comprising a light source 103 fitted to the inside of open end 7 of casing 2.

Light source 103 preferably comprises at least one LED source 105. In the non-limiting example described and illustrated, light source 103 comprises a plurality of LED sources 105.

In a variation not shown in the drawings, light source 103 comprises at least one laser.

In the FIG. 5 embodiment, besides controlling strobe assembly 5 (as described for light fixture 1), control device 38 also controls the movement and intensity of the light beam emitted by light source 103, and any light beam processing effects inside light fixture 100.

Figure 6:
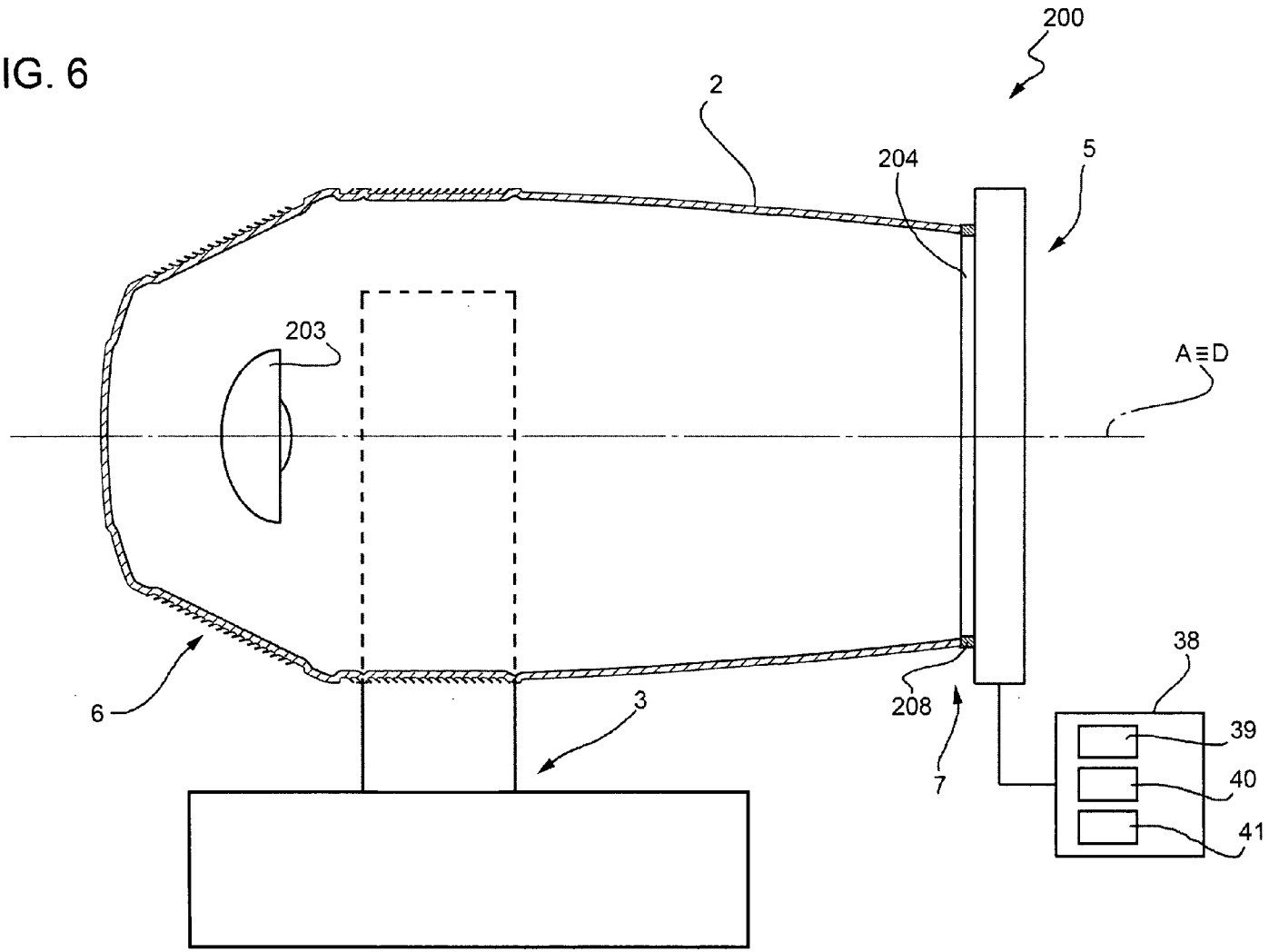
FIG. 6 shows a schematic, partly sectioned side view, with parts removed for clarity, of a stage light fixture in accordance with a third embodiment of the present invention.

FIG. 6 shows a stage light fixture 200 in accordance with a third embodiment.

In FIG. 6, similar parts of light fixtures 1 and 200 are indicated using the same reference numbers as in FIGS. 1-4.

Light fixture 200 differs from light fixture 1 by comprising a light source 203, and an objective lens 204.

Light source 203 is located inside closed end 6 of casing 2, and emits a light beam substantially along an optical axis D.

In the non-limiting example described and illustrated, optical axis D coincides with longitudinal axis A of casing 2.

Objective lens 204 is circular, and is fixed to the open end 7 of casing 2 so as to be centred about optical axis D and close casing 2. More specifically, objective lens 204 is fixed to a supporting ring 208, in turn fitted to casing 2, e.g. by screws (not shown in the drawings for the sake of simplicity).

To avoid intercepting the light beam, hole 17 in annular plate 15 of strobe assembly 5 is larger in diameter than objective lens 204.

In the non-limiting example described and illustrated, annular plate 15 is fixed to supporting ring 208 of objective lens 204.

In the FIG. 6 embodiment, besides controlling strobe assembly 5 (as described for light fixture 1), control device 38 also controls the movement and intensity of the light beam emitted by light source 203, and any light beam processing effects preferably located inside light fixture 200, between light source 203 and objective lens 204.

Light fixture 1, 100, 200 according to the present invention has the advantage of being compact and easy to handle, and emitting a directable stroboscopic light, by virtue of stroboscopic light source 11 being integral with casing 2, which rotates about two perpendicular PAN and TILT axes. This is particularly advantageous in situations requiring stroboscopic lighting of different areas (e.g. a concert stage and audience) using the same light fixture 1, 100, 200.

Light fixture 100, 200 is also designed to simultaneously emit stroboscopic light and a light beam, the combination of which produces unusually attractive optical effects to enhance the versatility of the light fixture.

The stroboscopic light emitted by light fixture 1, 100, 200 according to the present invention is also adjustable in intensity and pulse rate.

Lastly, activation, movement, intensity, and pulse rate of the stroboscopic light are controllable by the same control device 38 controlling the position and processing of the light beam emitted by light source 103, 203, which has obvious cost advantages in terms of fewer component parts, and obvious practical advantages in terms of centralized control.

Clearly, changes may be made to stage light fixture 1, 100, 200 as described herein without, however, departing from the scope of the accompanying Claims.

The invention claimed is:

1. A stage light fixture (1, 100, 200) comprising:
a casing (2);
a supporting structure (3) supporting said casing (2);
a light source (103, 203) fitted to the casing (2); and
a stroboscopic light source (11) which is fitted integrally to the casing (2) and is substantially annular;
wherein the stroboscopic light source (11) comprises at least one substantially semicircular stroboscopic lamp (22) in the form of at least one xenon lamp.

2. A light fixture as claimed in claim 1, wherein the supporting structure (3) and the casing (2) are designed to permit rotation of the casing (2) about two perpendicular axes (B, C).

3. A stage light fixture (1, 100, 200) comprising:
a casing (2);
a supporting structure (3) supporting said casing (2);
a light source (103, 203) fitted to the casing (2); and
a stroboscopic light source (11) which is fitted integrally to the casing (2) and is substantially annular;
wherein the stroboscopic light source (11) comprises at least one substantially semicircular stroboscopic lamp (22).

4. A light fixture as claimed in claim 1, wherein the stroboscopic light source (11) comprises two substantially semicircular stroboscopic lamps (22) connected to form a substantially annular stroboscopic light source (11).

5. A light fixture as claimed in claim 1, wherein the stroboscopic lamp (22) comprises a substantially semicircular-arc-shaped tube (23) filled with ionizable gas and having respective metal electrodes (25) at the ends (26).

6. A light fixture as claimed in claim 1, wherein the stroboscopic light source (11) is located outside the casing (2).

7. A light fixture as claimed in claim 1, wherein the stroboscopic light source (11) extends about the casing (2).

8. A light fixture as claimed in claim 3, wherein the light source (103) comprises at least one LED source (105).

9. A light fixture as claimed in claim 3, wherein the light source (103) is a laser.

10. A light fixture as claimed in claim 3, wherein the light source (203) is housed inside the casing (2), at a closed end (6) of the casing (2), and emits a light beam substantially along an optical axis (D).

11. A light fixture as claimed in claim 10, and comprising an objective lens (204) fitted to the casing (2), at an open end (7) of the casing (2).

12. A light fixture as claimed in claim 1, wherein the stroboscopic light source (11) is so located as not to intercept the light beam emitted by the light source (103, 203).

13. A light fixture as claimed in claim 1, wherein the stroboscopic light source (11) is located at an open end (7) of the casing (2).

14. A light fixture as claimed in claim 1, and comprising a control device (38) for selectively activating the stroboscopic light source (11).

15. A light fixture as claimed in claim 1, and comprising a control device (38) for regulating a light pulse rate of the stroboscopic light source (11).

16. A light fixture as claimed in claim 1, and comprising a control device (38) for regulating an intensity of the light pulses generated by the stroboscopic light source (11).

* * * * *